United States Patent [19]

Crook

[11] 4,315,654

[45] Feb. 16, 1982

[54] BABY BOTTLE FEEDER

[76] Inventor: John A. Crook, Glen Rd., R.R. #1, Williamstown, Ontario, Canada, K0C 2J0

[21] Appl. No.: 146,074

[22] Filed: May 2, 1980

[51] Int. Cl.[3] ..... A47C 9/14

[52] U.S. Cl. ..... 297/188; 248/102; 248/103; 248/107

[58] Field of Search ..... 297/188, 377, 135, 236, 297/238, 7, 14, 105, 112; 248/102, 103, 104, 107, 226.3, 101

[56] References Cited

U.S. PATENT DOCUMENTS

| | | | |
|---|---|---|---|
| 1,336,809 | 4/1920 | Batty | 248/104 X |
| 3,151,828 | 10/1964 | Alloy | 248/104 |
| 3,153,556 | 10/1964 | Westerback | 297/194 |
| 3,184,193 | 5/1965 | Melvin | 248/106 |
| 3,342,443 | 9/1967 | Bennyhoff | 248/104 |
| 3,635,431 | 1/1972 | Mariner | 248/104 |
| 4,014,505 | 3/1977 | Dowd | 248/105 |
| 4,121,797 | 10/1978 | MacNeil | 248/102 |

FOREIGN PATENT DOCUMENTS

| | | |
|---|---|---|
| 221213 | 7/1922 | Canada . |
| 430876 | 10/1945 | Canada . |
| 503314 | 5/1954 | Canada . |
| 745497 | 11/1966 | Canada . |

*Primary Examiner*—Ronald Feldbaum
*Attorney, Agent, or Firm*—Eric P. Schellin

[57] ABSTRACT

Support means for holding a nursing bottle are adapted to be removably secured to an infant seat such that the nursing bottle is held tightly in an upright stand-by position within reach of the infant and can easily and safely be manipulated by him.

8 Claims, 3 Drawing Figures

BABY BOTTLE FEEDER

The present invention relates to support means for holding a nursing bottle used in conjunction with an infant seat. The support means allow the nursing bottle to be positioned generally upright within reach of the infant so that the infant can feed whenever he wants to.

Devices of this type and for this purpose have been proposed but have not been completely satisfactory for various reasons. Representative of known devices of this type are those described in Canadian Pat. No. 503, 314 and U.S. Pat. Nos. 3,342,443, 3,184,193 and 3,635,431.

Canadian Pat. No. 503,314 to Battle describes a nursing bottle holding device comprising a supporting structure which is simply placed on a crib or the like and a bottle holder suspended from the supporting structure. In this arrangement the bottle is held pointing downwardly and is, therefore, likely to drip whenever the infant wants to stop feeding and tries to push or twist the bottle away from himself. Additionally, this bottle holding device is only practical for very small infants, as more active and stronger infants may cause it to topple over.

U.S. Pat. No. 3,342,443 to Bennyhoff describes a nursing bottle holding device using a metal loop as bottle holder. The loop is part of a generally U-shaped main body which is detachably connected to an infant seat. While the wire loop is assumed to firmly grip the bottle, it is not a very safe arrangement. The bottle can easily slide out of its support, particularly, when it is pushed out of the feeding position by the infant. The main body is pivotally attached to an infant seat, but once the infant pushes the bottle out of the feeding position he cannot resume feeding without the help of an attendant.

U.S. Pat. No. 3,184,193 to Melvin shows a nursing bottle holding device with a bottle holder which is rather complicated in design. The device is detachably connected to an infant seat and is adjustable to the size of the infant, but once put in place the infant cannot move it out of the feeding position without the help of an attendant.

In U.S. Pat. No. 3,635,431 to Mariner there is disclosed a nursing bottle device which is also detachably secured to an infant seat. This arrangement, however, cannot be adjusted in height. Furthermore, it does not provide much freedom for the infant as the spring action does not permit the infant to push and keep the bottle away from himself.

The present invention is designed to avoid this and other disadvantages of the known bottle holding devices.

It is an object of this invention to provide an improved nursing bottle support means adapted to be removably secured to an infant seat such that the nursing bottle is held tightly in a stand-by position within reach ofthe infant and can easily and safely be manipulated by him.

It is a further object of this invention to provide an improved nursing bottle support means which is equipped with counterbalance weights to minimize the pressure exerted on the gums of the infant while he is feeding.

Further objects and advantages of the invention will become apparent from the following description and claims and from the accompanying drawings.

According to the present invention there is provided a support means for a nursing bottle adapted to be secured to an infant seat and the like comprising a length of resilient tubing which includes a generally U-shaped portion and two substantially parallel legs. The generally U-shaped portion has a bight portion which takes the general configuration of an oarlock and is formed of a part of the resilient tubing which is flattened. The bight portion is adapted to slidably receive and firmly hold a nursing bottle in a plane perpendicular to that of said U-shaped portion. The two substantially parallel legs extending downwardly from said U-shaped portion and being continuous therewith are curved forwardly. The lower portion of the legs extends in a plane substantially perpendicular to the plane of the upper portion of the legs and the U-shaped portion. The legs terminate in a pair of foot portions equipped with counterbalance weights. The legs are adapted to be removably and pivotally secured to an infant seat.

In a preferred embodiment the support means is removably secured to the infant seat with resilient swivel clamps for pivotal movement of the support means between a feeding position and a stand-by position. The tubing and swivel clamps are made of plastic material, preferably PVC, and the foot portions are covered with plastic caps.

In a more preferred embodiment the legs of the support means snap into resilient swivel clamps secured to the infant seat. This arrangement allows for pivotal movement and adjustment of height.

In the drawings which illustrate, by way of example, a particular embodiment of the present invention:

Figure 1:
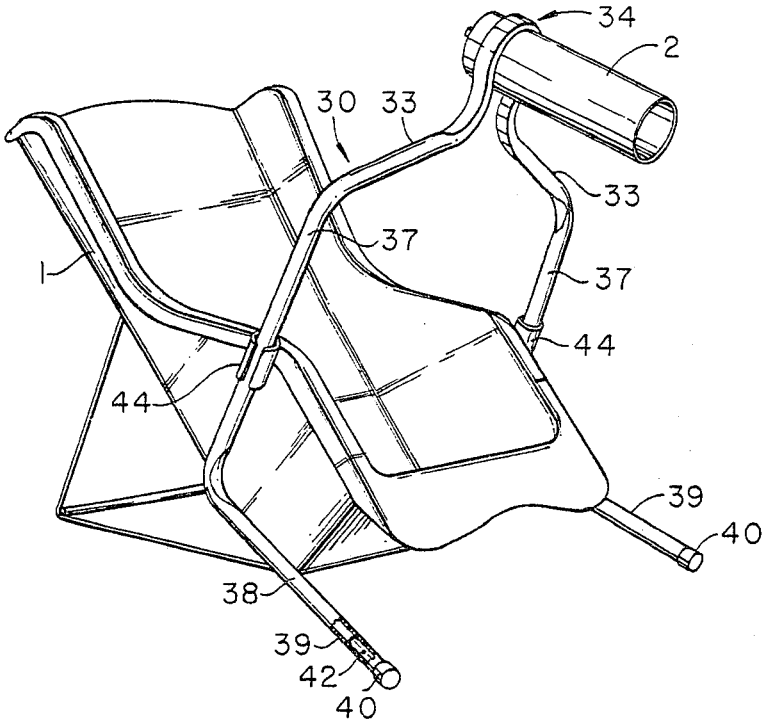
FIG. 1 is a perspective view showing an embodiment of the nursing bottle support means according to the invention in resting position secured to an infant seat.
Figure 2:
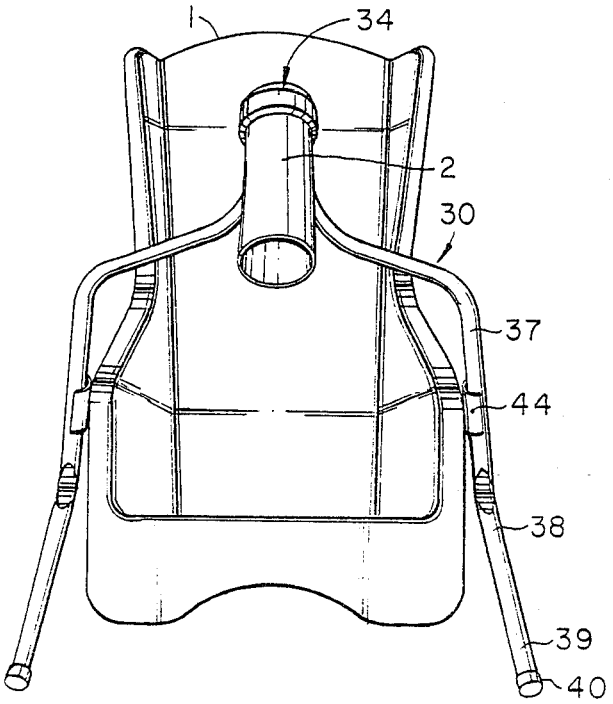
FIG. 2 is a front view of the support means illustrated in FIG. 1.

The support means 30 in FIG. 1 for holding the nursing bottle 2 are adapted for use with an infant seat 1.

Figure 3:
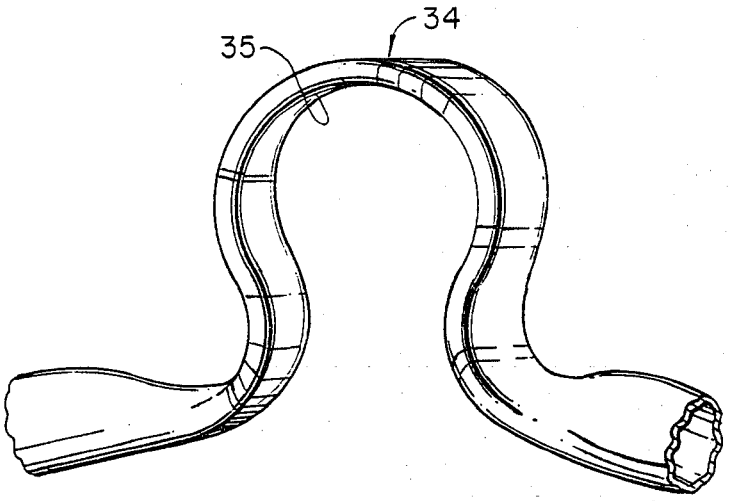
FIG. 3 is a detailed view of the oarlock-shaped bight portion of the support means illustrated in FIG. 1.

The support means 30 is made of resilient tubing. It comprises a generally U-shaped portion 33 and two substantially parallel legs extending downwardly from the U-shaped portion 33. The bight portion 34 of the U-shaped portion 33 is adapted to receive the nursing bottle 2 and to keep it in generally upright position when the infant is not feeding to prevent the bottle from dripping. To this end the bight portion is oarlock-shaped to receive and envelop the bottle. The part of the tubing which encompasses the bottle 2 is flattened as shown in FIG. 3 so as to provide a greater gripping surface 35 for the bottle and to ensure that the bottle is held in place firmly in a plane approximately perpendicular to the U-shaped portion 33.

The legs are curved forwardly such that the upper portion of the legs 37 is approximately perpendicular to the lower portion of the legs 38. The legs terminate in a pair of foot portions 39. Counterbalance weights 42 are inserted into the foot portions 39, so as to counterbalance the weight of the nursing bottle 2, when the infant is feeding. The foot portions are covered with plastic caps 40. The plastic caps keep the counterbalance weights 42 in place inside the tubing.

Figure 4:
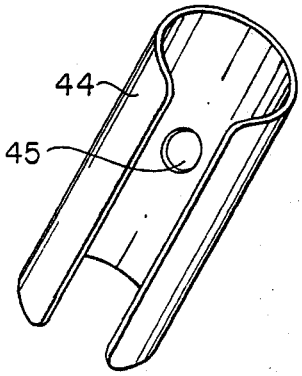
FIG. 4 is a detailed view of a swivel clamp.
Figure 5:
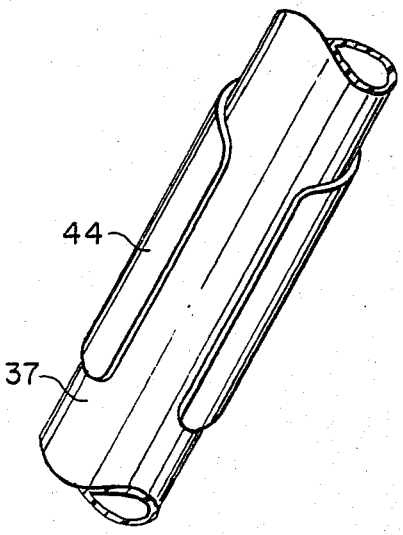
FIG. 5 is a view corresponding to FIG. 4 but having a leg portion of the support means snapped into the swivel clamp.

The support means are releasably and pivotally secured to the infant seat 1. In FIG. 1 the support means 30 is fastened to the seat with resilient swivel clamps 44 which are preferably made of plastic material. As shown in FIG. 4 the swivel clamps 44 are fastened to the infant seat with a bolt 45 in such a way that the clamps can rotate freely. The upper portion 37 of each leg snaps into one of the clamps 44. As shown in FIG. 5 the height of the support can easily be adjusted according to the size of the infant.

In stand-by position, shown in FIG. 1, the support means holds the bottle upright away from the infant's mouth, but still within his reach. The legs of the support means are shaped such that any increase in height of the support to suit larger infants, automatically results in an increase in distance between the infant's mouth and the bottle, when the latter is in stand-by position. This arrangement avoids crowding of the older infant and gives him enough room to play, while always keeping the bottle within his reach. In feeding position, the bottle will normally point downwardly. When the infant wants to feed, he merely has to reach out and tilt the support lightly towards himself until the bottle is in the desired position. The counterbalance weights ensure that the weight of the bottle does not rest on the infant's gums while he is feeding. When the infant wants to relax, he simply releases the support and the bottle will return to the stand-by position.

From the foregoing description further modifications and embodiments will be apparent to those skilled in the art, and the embodiments disclosed are intended only to illustrate the invention without limiting the scope thereof.

What is claimed is:

1. A support means for a nursing bottle adapted to be secured to an infant seat and the like, comprising a length of resilient tubing including (a) a generally U-shaped portion, the bight portion of which takes the general configuration of an oarlock and is formed of a part of said resilient tubing which is flattened; said bight portion being adapted to slidably receive and firmly hold a nursing bottle in a plane perpendicular to that of said U-shaped portion;

(b) two substantially parallel legs extending downwardly from said U-shaped portion and being continuous therewith, said legs being curved forwardly, the lower portion of said legs extending in a plane substantially perpendicular to the plane of the upper portion of said legs and said U-shaped portion, said legs terminating in a pair of foot portions equipped with counterbalance weights; said legs being adapted to be removably and pivotally secured to an infant seat.

2. A support means as in claim 1 wherein said support means is removably secured to an infant seat with resilient swivel clamps for pivotal movement of the support means between a feeding position and a stand-by position.

3. A support means as in claim 1 wherein said legs of said support means are removably secured to an infant seat with resilient swivel clamps such as to allow for pivotal movement and adjustment of height.

4. A support means as in claim 3 wherein said legs snap into said swivel clamps.

5. A support means as in claim 3 wherein said resilient swivel clamps are made of plastic material.

6. A support means as in claim 1 wherein said resilient tubing is made of plastic material.

7. A support means as in claim 1 wherein said resilient tubing is made of PVC.

8. A support means as in claim 1 wherein said end of said pair of foot portions are covered with plastic caps.

* * * * *